US007002530B1

(12) United States Patent
Chung et al.

(10) Patent No.: US 7,002,530 B1
(45) Date of Patent: Feb. 21, 2006

(54) ANTENNA

(75) Inventors: Shyh-Jong Chung, Hsinchu (TW); Yu-Shin Wang, Taichung (TW)

(73) Assignee: Etop Technology Co., Ltd., Miaoli (TW)

( * ) Notice: Subject to any disclaimer, the term of this patent is extended or adjusted under 35 U.S.C. 154(b) by 0 days.

(21) Appl. No.: 10/711,676

(22) Filed: Sep. 30, 2004

(51) Int. Cl.
*H01Q 1/36* (2006.01)

(52) U.S. Cl. ..... 343/895; 343/822; 333/26

(58) Field of Classification Search ..... 343/821, 343/822, 895, 702; 333/25, 26
See application file for complete search history.

(56) References Cited

U.S. PATENT DOCUMENTS 5,172,082 A * 12/1992 Livingston et al. ..... 333/26
5,523,728 A * 6/1996 McCorkle ..... 333/128
6,011,524 A * 1/2000 Jervis ..... 343/895
6,072,441 A * 6/2000 Tanabe ..... 343/895
6,334,048 B1 * 12/2001 Edvardsson et al. ..... 455/575.7
6,480,173 B1 * 11/2002 Marino ..... 343/895
6,759,920 B1 * 7/2004 Cheung et al. ..... 333/25
6,803,835 B1 * 10/2004 Frank ..... 333/26
6,886,237 B1 * 5/2005 Leisten et al. ..... 29/600
6,891,448 B1 * 5/2005 De Flaviis ..... 333/26
6,900,706 B1 * 5/2005 De Flaviis ..... 333/26
6,919,859 B1 * 7/2005 McCarthy et al. ..... 343/895

* cited by examiner

*Primary Examiner*—Tan Ho
(74) *Attorney, Agent, or Firm*—Jianq Chyun IP Office

(57) ABSTRACT

An antenna has a central core with a central coupling region. A pair of helix antenna lines is formed a surface of the central core. A balun transformer is formed on a circuit board and electrically coupled to the pair of radiating antenna lines. Wherein, the circuit board has a protruding structure to affixing into the central coupling region of the central core. A signal input/output (I/O) end of the antenna is at another end of the balun transformer. The balun transformer preferably uses the LC resonators in two paths with a desired equivalent resonant length, so as to preferably produce the difference by half wavelength.

20 Claims, 8 Drawing Sheets

ANTENNA

BACKGROUND OF THE INVENTION

1. Field of Invention

The present invention relates to an antenna structure. More particularly, the present invention relates to a helix antenna on a dielectric core.

2. Description of Related Art

Antenna is a necessary element in wireless communication. Usually, the radio-frequency (RF) signals, carrying information, are transmitted or received at the antenna. Then, the RF signals are further processed to obtain the actual information be carried. Due to the design of the signal processing circuit, the RF signal in EM-wave has its desired polarization state. Usually, it is a linear polarization or a circular polarization. The polarization state can be generated by a specific antenna structure.

In the modern life, mobile phone has been a very popular wireless communication apparatus. The mobile phone also needs to use the GPS to identify the position. In order to reduce the volume of the GPS unit, the size of antenna is necessary to be reduced. Particularly, if the volume of the mobile phone is intended to be reduced, the antenna size is also necessary to be reduced.

The basic antenna structure for generating the circular polarization RF signals has been well known in the art. FIG. 1 is a basic conventional structure of antenna in circular polarization. In FIG. 1, two antenna line structures 100, 102 are composed together in perpendicular crossing. The two antenna line structures 100, 102 are implemented on a straight signal cable 104. The two antenna line structures 100, 102 are respectively and electrically coupled to the signal cable 104 at the top end 106. The two antenna line structures 100, 102 at the other end 108 are commonly connected. By adjusting the length of the antenna in difference for the two antenna line structures 100, 102, a circular polarization can be obtained.

The antenna structure in FIG. 1 is rather conventional. The operation is not further described in detail. Since the antenna structure in FIG. 1 used no dielectric material, the size is large to produce the desired wavelength. FIG. 2 is another conventional design of helix antenna. This conventional antenna product is a type of Quadrifilar Helix Antenna (QHA). Basically, two pairs of antenna lines 120 are in helix structure and are formed on a dielectric rod core 122. The input impedance Zin of the antenna is about 1–5 ohms when using a dielectric core with high dielectric constant. However, the usual signal cable impedance is 50 ohms in the signal processing side. A long low-impedance cable 124 is thus needed for impedance transformation. This kind of cable is rather expensive. Also and, this antenna needs a large balun transformer 126 at the bottom side opposite to the signal coupling end. In this manner, since the balun transformer 126 occupies some space, the size of antenna cannot be further reduced.

In order to have better performance of antenna but with rather reduced size, some other designs of antenna are still under developing. Manufacturers still strongly intend to design an antenna with sufficient function but reduced size. Then, the antennal can be widely used in various wireless communication apparatus.

SUMMARY OF THE INVENTION

The invention provides an antenna structure with a balun transformer, which is formed on a circuit board. As a result, the helix wire part and the balun transformer are electrically coupled together. The balun transformer can maintain a well balance between the pair of antenna wires for the helix wire part. The helix antenna of the invention can be, for example, a quadrifilar helix antenna (QHA) or a bifilar helix antenna (BHA).

According to an aspect of the invention, the invention provides an antenna, which comprises a central core, having a central coupling region. At least one pair of helix antenna lines is formed on a surface of the central core. A balun transformer is formed on a circuit board and electrically coupled to the pair of radiating antenna lines. Wherein, the circuit board has a protruding structure to affixing into the central coupling region of the central core. A signal input/output (I/O) end of the antenna is at another end of the balun transformer.

According to another aspect of the invention, the pair of radiating antenna lines includes a meander structure or a line-width adjusting structure at a location, at which a current is minimal. Usually, the location is about at the central region of the helix antenna lines.

According to another aspect of the invention, the balun transformer includes two paths, and each of the paths includes a capacitor and an inductor, so that a desired equivalent length for each of the paths is obtained. Also and, the balum part can also provide the transforming function for the impedance matching.

According to another aspect of the invention, the two paths of the balun transformer are formed on a same side of the circuit board or on different side of the circuit board.

According to another aspect of the invention, the invention provides balun transformer, which is suitable for use in electrical coupling to an antenna radiating part. The balun transformer comprises a circuit board. A first path is formed on the circuit board, having a first equivalent length. The first path includes a circuit composed of a capacitor and an inductor. A second path, having a second equivalent length, is formed on the circuit board, including a circuit composed of a capacitor and an inductor. Wherein, the first path and the second path have a commonly connected node to serve as a signal input/output (I/O) end.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

In the invention, the design principle for the antenna is arranging the balun transformer on a separated circuit board. The antenna radiating part is separated formed on a dielectric core, such as a ceramic rod core. Then, the balun transformer is electrically coupled to the antenna radiating part. Signals are fed from the other end of the balun transformer. The balun transformer has the balun effect and the effect of impedance transformation.

Figure 3A:
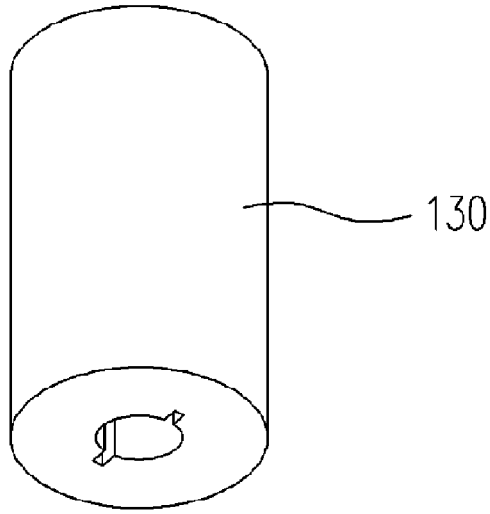
FIGS. 3A and 3B are perspective drawing, schematically illustrating the parts of the helix antenna, according to an embodiment of the present invention.
Figure 3B:
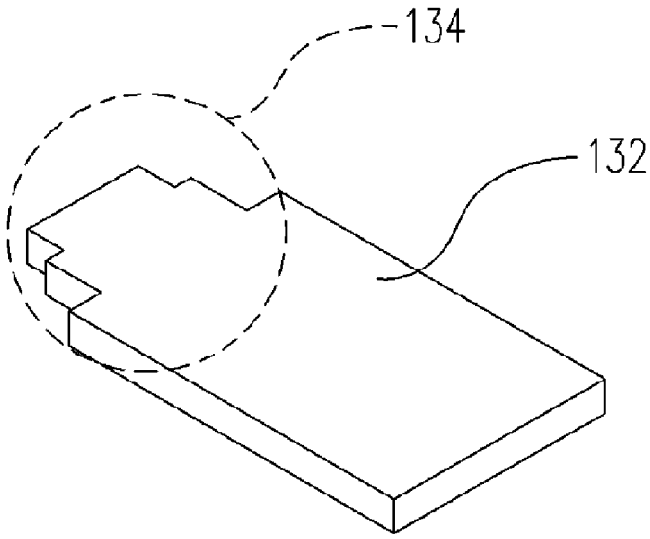

Embodiments are provided as the examples for descriptions. FIGS. 3A and 3B are perspective drawing, schematically illustrating the parts of the helix antenna, according to an embodiment of the present invention. In FIG. 3A, an antenna core 130 is used as medium material of the antenna. The antenna core 130 can be, for example, a dielectric rod, such as a ceramic rod. A through hole is, for example, formed at the central region. However, this through hole is a design choice, for allowing a circuit board 132 to be easily coupled to the antenna core 130, as to be described later. The through hole is not the only choice. In general, this is referred to a central coupling region or a central coupling structure. Radiating antenna lines are to be formed on the surface of the antenna core 130, as to be described later.

In FIG. 3B, a circuit board 132 is provided. The balun transformer of the antenna is separately formed on the circuit board 132. In order to firmly affix the circuit board 132, the circuit board 132 has a protruding structure 134 to be inserted into the through hole of the antenna core 130 which may include the groove to mechanically adapt the circuit board 132. The circuit design is described as follows.

Figure 4:
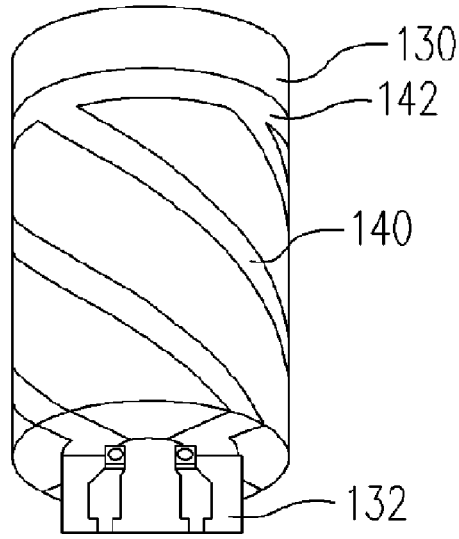
FIGS. 4–6 are perspective drawing, schematically illustrating various designs about the helix lines and the coupling structure between the helix lines and the balun board, according to the embodiments of the present invention.
Figure 5:
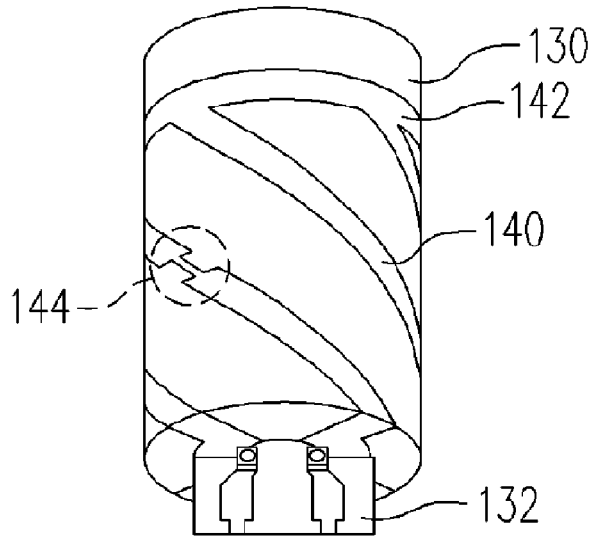
Figure 6:
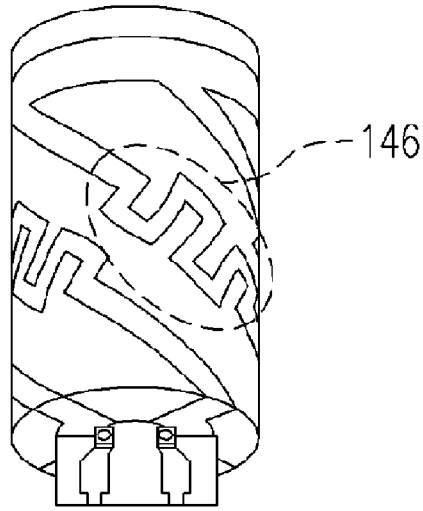

FIGS. 4–6 are perspective drawing, schematically illustrating various designs about the helix lines and the coupling structure between the helix lines and the balun board, according to the embodiments of the present invention.

In FIG. 4, the antenna usually is formed by one or two pairs of radiating lines 140. Here, two pairs as the QHA are shown as the example. In order to have sufficient radiating length, the radiating line 140 is in helix type. The example is a QHA for generating a circular polarization state, as the example but not the only limitation in the invention. The helix radiating lines 140 are formed on the surface of the antenna core 130. According to the invention, the pairs of the helix lines are connected together by the metal ring 142 at the other end opposite to the end, which is connected with the balun transformer on the circuit board 132. It should be noted that the ring 142 is not the conventional balun, so that the width of the ring 142 can be small.

Each one of the pairs of the helix lines 140 is respectively coupled to a circuit path of balun transformer on the circuit board 132. The detail is to be described later. In this manner, the radiating helix lines 140 are formed on the antenna core 130. In other words, the balun transformer is not formed on the antenna core 130. Therefore, the length of the antenna core 130 can be effectively reduced.

In order to have sufficient length of the helix line, FIG. 5 shows another design. The line width is thinner at the location 144 on one pair, with respect to one BHA. The thinner width produces a shorter equivalent length even though the actual physical length is the same. The different operating lengths for the two pairs of BHA are to produce the circular polarization as the QHA, according to the electromagnetic wave theory. The choice of the location 144 is under the consideration to prevent much radiating loss. In this consideration, the location of the antenna with the minimal current is preferred. The location 144 is then also preferably located at about central region of the helix lines, at which region the current is usually smaller.

In FIG. 6, another design for helix lines is shown. For this example, the meander structure 146 is used to have sufficient length but is shorter extension. The line width of the helix lines 140 may be not necessary to be reduced, as shown in FIG. 5. However, since the meander structure 146 provides the required length, the total extending length of the helix line 140 is shorter. The total antenna size is then effectively reduced. The location of the meander structure 146 is under the same consideration as that for the location 144 in FIG. 5. In other words, the meander structure 146 preferably is located at the place with relatively smaller current, or the minimum current.

For the structure described in FIGS. 4–6, these methods can provide BHA different resonant frequency. Using two BHA's with proper different resonant frequencies, the design of QHA formed from two BHA can achieve one circular-polarized QHA. The resonant frequency is adjusted by adjusting the equivalent operating length.

Figure 1:
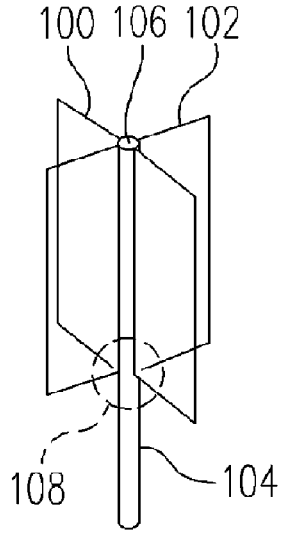
FIG. 1 (PRIOR ART)
FIG. 1 is a drawing, schematically illustrating a conventional circular polarization antenna.
Figure 2:
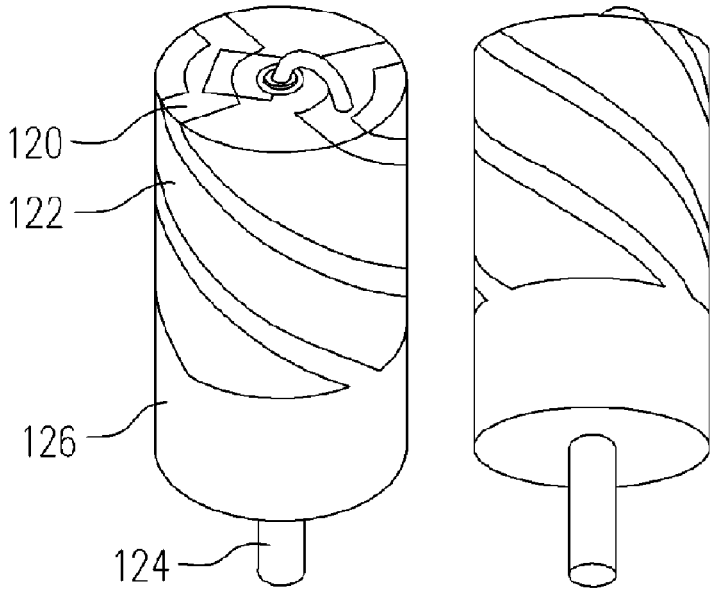
FIG. 2 (PRIOR ART)
FIG. 2 is a drawing, schematically illustrating a conventional quadrifilar helix antenna.
Figure 7:
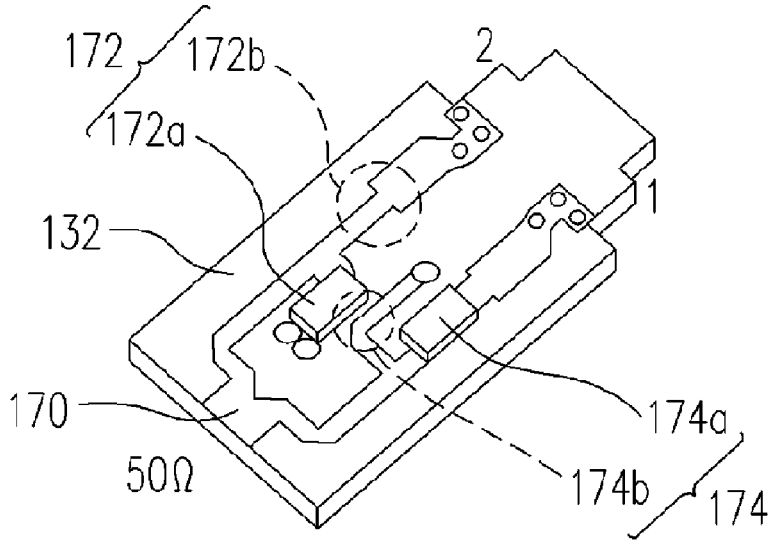
FIG. 7 is a drawing, schematically illustrating a structure of the balun board, according to the embodiment of the present invention.

The helix radiating lines 140 are formed in two pairs, and the helix structure is the QHA as the example. However, the feeding signals are usually not in this way. As known by the ordinary skill artisans, the antenna needs the balun to transform the signal from single into pair in well balance. In the invention, the balun transformer is separately formed on a circuit board. Also and, the balun transformer can also provide the capability to match the impedance. The conventional expensive transforming cable 124 (see FIG. 2) is not necessary in the invention. FIG. 7 is a drawing, schematically illustrating a structure of the balun circuit board, according to the embodiment of the present invention. In FIG. 7, the balun circuit is formed on the circuit board 132 with two paths 1 and 2. Each path includes a capacitor and an inductor. For example for the path 1, it includes a capacitor 174*a* and an inductor 174*b*, forming as an LC resonator 174. The inductor 174*b* can be simply formed by a thin metal line. Due to the property of LC resonance, it can produce an equivalent length, such as ¾λ. Another end 170 of the path 1 is i.e. receiving the 50 ohm input signal. Similarly, for the path 2, it also includes a capacitor 172*a* and an inductor 172*b*, forming as an LC resonator 172. The difference is the coupling structure of the capacitor 172*a* and the inductor 172*b*. The quantities of the inductors 172*b* and 174*b* can be the same for easy implementation. So are those of the capacitors 172*a* and 174*a*. The path 2 is desired to have the length of ¼λ. As a result, the two paths have a difference by half wavelength, which also produces a 180° phase difference, to perform the balun function. The other end of the path 2 is coupled with the path at the end 170. Therefore, the 50-ohm input signals are fed to the balun circuit and then enter the helix lines 140. The input impedance at the other end is about 1–5 ohms. Therefore, the impedance transformation is simultaneously achieved without additional transforming cable.

Figure 8:
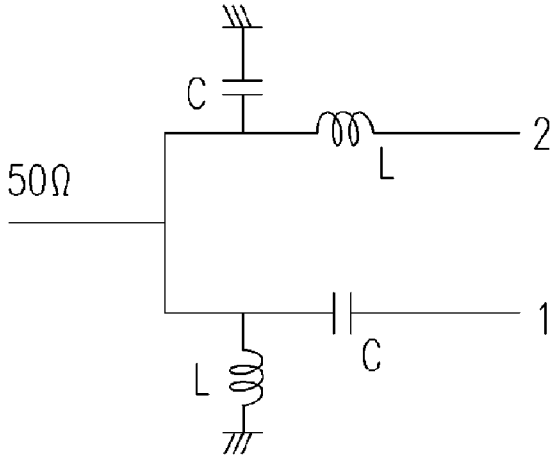
FIG. 8 is a circuit drawing, schematically illustrating the equivalent circuit of the balun circuit in FIG. 7, according to the embodiment of the present invention.

FIG. 8 is a circuit drawing, schematically illustrating the equivalent circuit of the balun circuit in FIG. 7, according to the embodiment of the present invention. In FIG. 8, the 50-ohm signals are fed to the path 1 and path 2 at the same time. In path 1, the input signals go through the LC resonator, which has an inductor L connected to the ground and a capacitor C connected to the first output end. In path 2, the input signals go through the LC resonator, which has a capacitor C connected to the ground and an inductor L connected to the second output end. The balun circuit is used, for example, to produce a phase different of 180°, so that a balance for the pair of the helix lines 140 can be achieved.

Figure 9:
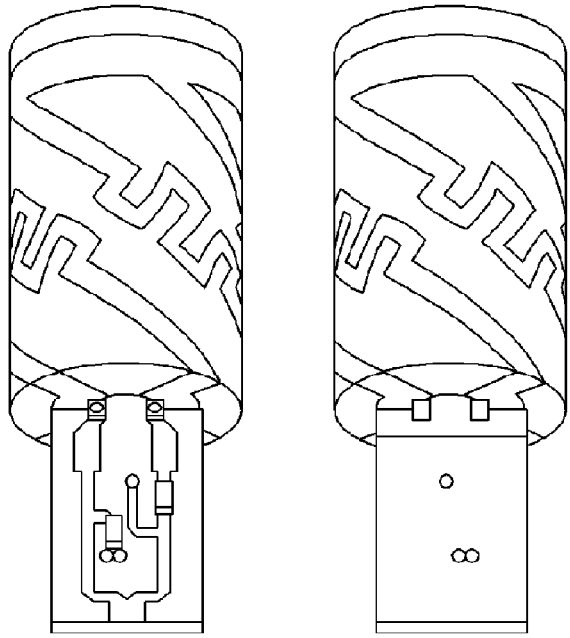
FIG. 9 is a structure drawing, schematically illustrating the coupling structure between the helix lines and the balun circuit in QHA type, according to the embodiments of the present invention.

FIG. 9 is a structure drawing, schematically illustrating the coupling structure between the helix lines and the balun circuit in QHA type, according to the embodiments of the present invention. In FIG. 9, the QHA of the invention is shown from both sides. In one-side view (left drawing), the circuit board 132 is inserted into the through hole (see FIG. 3A and FIG. 3B). Then, the path 1 and the path 2 are respectively coupled to the helix lines 140. Since the factor of signal balance is quite important to have better performance, the balun circuit of the invention can be equally fed to the helix lines 140 to maintain the balance operation. In the invention, since the balun circuit is formed on the circuit board 132, the balun circuit can be properly electrically coupled to the helix lines 140 by design the protruding structure 134 of the circuit board 132. The description is just an example. Here, a ground area is formed on the backside of the circuit board.

The foregoing antenna is the QHA type. However, the QHA is basically composed by two pairs of BHA with different resonant frequencies. The balun circuit shown in FIG. 7 is the example, in which the two paths 1 and 2 are formed at the same side of the circuit board. Alternatively, the two paths can be respectively formed on both sides of the circuit board 132 with multilayer configuration. The design of the balun circuit on both sides of the circuit board is shown as follows.

Figure 10A:
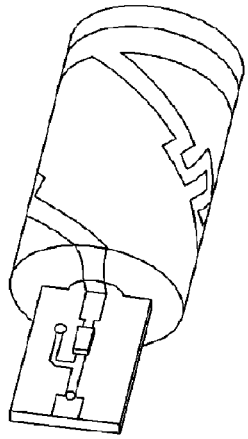
FIGS. 10*a*–10*c* are structure drawings, schematically illustrating the coupling structure between the helix lines and the balun circuit in BHA type, according to the embodiments of the present invention.
Figure 10B:
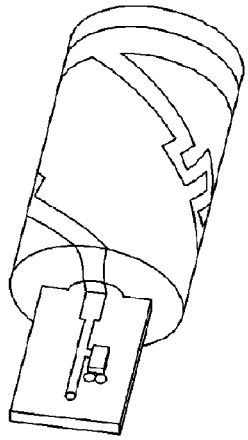
Figure 10C:
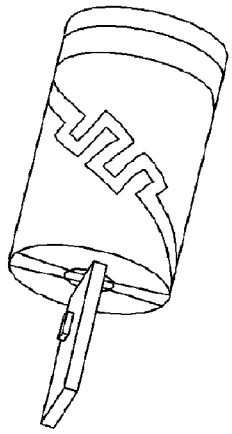

FIGS. 10*a*–10*c* are structure drawings, schematically illustrating the coupling structure between the helix lines and the balun circuit in BHA type, according to the embodiments of the present invention. Here, the BHA is taken as the example but the same design principle can also be applied to the QHA. In FIG. 10*a*, on side of the BHA is shown. For example, only the path 1 is formed on this side. After assembling the circuit board 132 to the central core 130, the output end is properly electrically connected to one helix line. In FIG. 10*b*, it is the view from the side opposite to the viewing side in FIG. 10*a*. *The path* 2 is formed on this side, so as to electrically connect to the other helix line. A ground plane is placed in the middle layer of the multilayer circuit board 132 so as to separate the signals on the two paths. The input signals are fed at the same time to the path 1 and the path 2. The signal input design to the two paths can have various options in the art. In FIG. 10*c*, a side view is shown. It can be seen that the two paths 1 and 2 on both sides of the circuit board 132 can properly connected to the pair of helix lines.

Figure 11A:
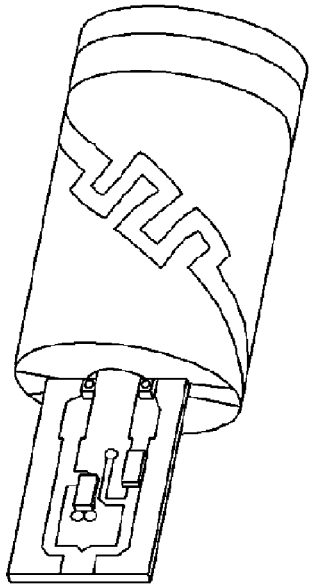
FIGS. 11*a*–11*b* are structure drawings, schematically illustrating the coupling structure between the helix lines and the balun circuit in BHA type, according to another embodiments of the present invention.
Figure 11B:
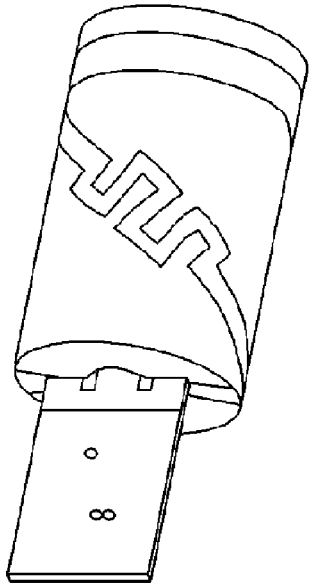

FIGS. 11*a*–11*b* are structure drawings, schematically illustrating the coupling structure between the helix lines and the balun circuit in BHA type, according to another embodiments of the present invention. The balun circuit in FIG. 7 can also be applied to the central core 130. FIG. 11*a* shows one side and FIG. 11*b* shows the opposite side. However, in order to have batter balance in connection, the circuit board 132 is turned by 90 degrees, so as to match the paths.

In general, the balun circuit of the invention can be applied to any type of antenna with a pair structure. The QHA or the BHA is the examples for descriptions. Since the balun circuit is formed on the circuit board, the two paths can be formed on the same side or the different sides. A connection balance can be easily achieved. This can further improve the signal balance in operation. The design properties in the foregoing descriptions can be combined to each other without only limitation to the QHA or BHA. Even further, the balun circuit can be applied to the general antenna design. Since the balun circuit is formed on the circuit board, the balun circuit can be easily adapted to various possible antenna designs.

Figure 12:
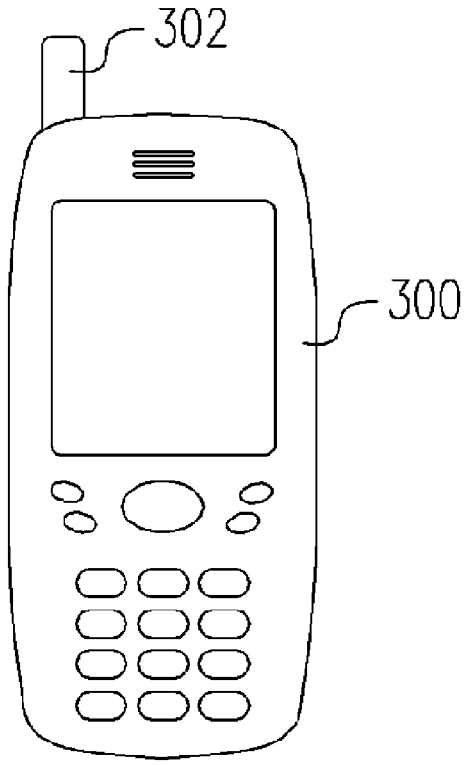
FIG. 12 is a drawing, schematically illustrating the application of the antenna of the invention in a wireless communication apparatus.

Furthermore, the novel antenna of the invention can be applied to the wireless communication apparatus. FIG. 12 is a drawing, schematically illustrating the application of the antenna of the invention in a wireless communication apparatus. In FIG. 12, the wireless communication apparatus includes, for example, a mobile phone. The wireless communication apparatus, such as mobile phone, includes the functional unit 300 to perform any necessary signal processes and/or display. The novel antenna 302 of the invention is included to receive and transmit the RF signals. The invention has proposed an antenna with reduced size. Particularly, the balun circuit is separately formed on the circuit board by for example LC resonators.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An antenna, comprising:

a central core, having a central coupling region;

one or two pairs of radiating antenna lines, formed a surface of the central core; and a balun transformer, formed on a circuit board and electrically coupled to the pair of radiating antenna lines, wherein the circuit board has a protruding structure to affixing into the central coupling region of the central core, wherein a signal input/output (I/O) end of the antenna is at another end of the balun transformer.

2. The antenna of claim 1, wherein the central core includes a dielectric rod.

3. The antenna of claim 1, wherein the two pairs of radiating antenna lines form a qudrifilar helix antenna (QHA).

4. The antenna of claim 1, wherein the one pair of radiating antenna lines forms a bifilar helix antenna (BHA).

5. The antenna of claim 1, wherein the pair of radiating antenna lines includes a meander structure or a line-width adjusting structure at a location, at which a current is minimal.

6. The antenna of claim 1, wherein the pair of radiating antenna lines includes a meander structure or a line-width adjusting structure at a central region of each of the helix antenna lines.

7. The antenna of claim 1, wherein the balun transformer includes two paths, and each of the paths includes a capacitor and an inductor, so that a desired equivalent length for each of the paths is obtained.

8. The antenna of claim 7, wherein one of the two paths has an equivalent one-quarter wavelength and another one of the two paths has an equivalent three-quarter wavelength.

9. The antenna of claim 7, wherein the two paths of the balun transformer are formed on a same side of the circuit board.

10. The antenna of claim 7, wherein the two paths of the balun transformer are formed on different side of the circuit board.

11. The antenna of claim 1, wherein the central coupling region of the central core has a hole with a groove, so as to adapt the protruding structure of the circuit board.

12. A wireless communication apparatus, comprising:

a main functional unit; and an antenna as recited in claim 1, for transmitting and receiving radio-frequency (RF) signals.

13. The wireless communication apparatus of claim 12, wherein the pair of radiating antenna lines includes a meander structure or a line-width adjusting structure at a location, at which a current is minimal.

14. The wireless communication apparatus of claim 12, comprising a mobile phone.

15. The wireless communication apparatus of claim 12, wherein the balun transformer includes two paths, and each of the paths includes a capacitor and an inductor, so that a desired equivalent length for each of the two paths is obtained.

16. The wireless communication apparatus of claim 15, wherein the two paths have an equivalent length difference by half wavelength.

17. A balun structure, suitable for use in electrical coupling to an antenna radiating part, the balun structure comprising:

a circuit board;

a first path on the circuit board, including a circuit formed from a capacitor and an inductor, so as to have a first equivalent length with respect to an operating wavelength; and a second path on the circuit board, including a circuit formed from a capacitor and an inductor, so as to have a second equivalent length with respect to the operating wavelength, wherein an equivalent length difference between the first and the second paths is half wavelength, wherein the first path and the second path have a commonly connected node for serving as a signal input/output (I/O) end.

18. The balun structure of claim 17, wherein the first wavelength path and the second wavelength path are on the circuit board on a same side or on different sides of the circuit board.

19. The balun structure of claim 17, wherein the balun structure is also used to match impedances between a 50-ohm signal line and an input impedance of the antenna radiating part.

20. The balun structure of claim 17, wherein the inductor for each of the two paths is a metal line.

* * * * *